US008853107B2

(12) United States Patent
Ueda

(10) Patent No.: US 8,853,107 B2
(45) Date of Patent: Oct. 7, 2014

(54) INDUSTRIAL TWO-LAYER FABRIC

(75) Inventor: Ikuo Ueda, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 4 days.

(21) Appl. No.: 13/308,125

(22) Filed: Nov. 30, 2011

(65) Prior Publication Data

US 2012/0135657 A1 May 31, 2012

(30) Foreign Application Priority Data

Nov. 30, 2010 (JP) ..... 2010-267192

(51) Int. Cl.

| | |
|---|---|
| ***D03D 11/00*** | (2006.01) |
| ***D03D 13/00*** | (2006.01) |
| ***D03D 25/00*** | (2006.01) |
| ***D21F 1/00*** | (2006.01) |
| ***D21F 7/08*** | (2006.01) |

(52) U.S. Cl.

CPC ..... *D21F 1/0036* (2013.01); *D21F 7/083* (2013.01)

USPC ..... 442/206; 442/203; 442/205; 139/383 AA

(58) Field of Classification Search

USPC ..... 442/203, 205, 206, 204; 139/383 A, 139/383 AA, 408

See application file for complete search history.

(56) References Cited

U.S. PATENT DOCUMENTS

| | | | | |
|---|---|---|---|---|
| 4,071,050 | A * | 1/1978 | Codorniu | 139/383 A |
| 7,306,014 | B2 * | 12/2007 | Nagura et al. | 139/383 AA |
| 7,445,032 | B2 * | 11/2008 | Barrett et al. | 139/383 A |
| 7,484,537 | B2 * | 2/2009 | Ueda | 139/383 A |
| 7,882,857 | B1 * | 2/2011 | Ueda | 139/383 A |
| 2003/0010393 | A1 * | 1/2003 | Kuji | 139/383 A |
| 2003/0217782 | A1 * | 11/2003 | Nagura et al. | 139/383 A |
| 2006/0048838 | A1 * | 3/2006 | Takimoto | 139/383 A |
| 2008/0264511 | A1 * | 10/2008 | Boeck | 139/383 A |
| 2009/0283233 | A1 * | 11/2009 | Boeck et al. | 162/202 |
| 2012/0135657 | A1 * | 5/2012 | Ueda | 442/203 |

FOREIGN PATENT DOCUMENTS

| | | | | |
|---|---|---|---|---|
| EP | 672782 | A1 * | 9/1995 | D21F 1/00 |
| JP | 2004-036052 | A | 2/2004 | |
| JP | 2004-068168 | A | 3/2004 | |

* cited by examiner

*Primary Examiner* — Jeremy R Pierce

(74) *Attorney, Agent, or Firm* — Rader, Fishman & Grauer PLLC

(57) ABSTRACT

An industrial two-layer fabric includes a first warp set and a second warp set that are placed alternately and form a weave design of the upper side fabric. The first warp set contains two upper side warps. At least one of the upper side warps of the first warp set functions as a warp binding yarn that binds the upper side fabric and the lower side fabric. The second warp set contains one of upper side warps and one of lower side warps placed below the one of the upper side warps. At a position where two adjacent lower side warps are woven with one of the lower side wefts, the warp binding yarn placed between the two adjacent lower side warps is woven with the same one of the lower side wefts.

9 Claims, 6 Drawing Sheets

INDUSTRIAL TWO-LAYER FABRIC

CROSS-REFERENCES TO RELATED APPLICATION

This application claims priority from Japanese Patent Application Serial No. 2010-267192 filed Nov. 30, 2010, the contents of which are incorporated herein by reference in their entirety.

BACKGROUND OF THE INVENTION

1. Field of the Invention

The present invention relates to an industrial two-layer fabric that does not collapse mesh openings at an interwoven position of a binding yarn, is excellent in rigidity, water drainability, wear resistance, and fiber supporting property, and exhibits uniform dehydration characteristics throughout the fabric.

2. Description of the Related Art

Fabrics obtained by weaving warps and wefts have conventionally been used widely as an industrial fabric. They are, for example, used in various fields including papermaking fabrics, conveyor belts, and filter cloths and are required to have fabric properties suited for the intended use or using environment. Of such fabrics, a papermaking fabric used in a papermaking step for removing water from raw materials by making use of the mesh openings of the fabric must satisfy a severe demand. For example, there is therefore a demand for the development of fabrics that have excellent surface smoothness and do not transfer a wire mark of the fabric to paper, have a dehydration property to sufficiently and uniformly dehydrate excessive water contained in the raw materials, have enough rigidity and wear resistance which enable suited use even under severe environments, and are capable of maintaining conditions necessary for making good paper for a prolonged period of time. In addition, they are required to have a fiber supporting property, improved papermaking yield, dimensional stability, running stability, and the like. In recent years, owing to the speed-up of a paper making machine, requirements for papermaking fabrics become severer.

Most of the demands for industrial fabrics and solutions thereof can be understood from a description on papermaking fabrics on which the most severe demand is imposed among industrial fabrics. A description will next be made with the papermaking fabric as an example.

With a recent increase in the speed of a papermaking machine, papermaking fabrics are required to have a particularly excellent dehydration property and surface smoothness. Although dehydration characteristics which they are required to have differ with the type of a papermaking machine or the type of a product to be manufactured, a uniform dehydration property is one of essential conditions for any product. Further, it becomes more difficult to satisfy the demand for papermaking fabrics because an increase in a mixing rate of minute fibers in raw materials as a result of recent increased use of waste paper causes insufficient dehydration so that sufficient and uniform dehydration has gained in importance.

As fabrics exhibiting a good dehydration property, there are two-layer fabrics having a dehydration hole penetrating through from the upper surface side to the lower surface side thereof. In particular, as fabrics designed to satisfy a surface property, fiber supporting property, and dehydration property which papermaking fabrics are required to have, two-layer fabrics using a warp binding yarn to be woven with an upper side weft and a lower side weft to form an upper side warp design and a lower side warp design, respectively, are known. Japanese Patent Laid-Open No. 2004-36052 discloses a two-layer fabric using a warp binding yarn. The fabrics of such related art are two-layer fabrics using some of warps as a warp binding yarn functioning as a binding yarn for weaving an upper side layer and a lower side layer. The warp binding yarn constituting a set complements an upper side warp design and a lower side warp design to form each of the surface designs so that fabrics thus obtained are excellent in surface property and binding strength.

Japanese Patent Laid-Open No. 2004-68168 discloses a two-layer fabric having a set of an upper side warp and a warp binding yarn with a view to achieving a uniform dehydration property. This fabric has a uniform design on the surface thereof by using an upper side knuckle of the warp binding yarn for weaving upper and lower surfaces and an upper side warp design in combination. This fabric is free of a collapse of the design because the above-described two warps cooperatively form a design corresponding to a single warp on the surface, but one of or both of the warps should collapse the design of the warp itself. They form a crossing portion when running between the upper side and the lower side and the warps constituting a first warp set is placed as a single warp. The two warps do not overlap each other along a line corresponding to a single warp but are arranged side by side so that the warp binding yarn clogs a mesh opening near the position where it is woven with an upper side weft. This causes a partial change in the dehydration characteristics of a wire and may transfer a mark to paper.

Such a two-layer fabric has, throughout the fabric, dehydration holes completely penetrating through from the upper side layer to the lower side layer so that it has a good dehydration property. Sheet raw materials on a wire stick to the fabric due to powerful vacuuming or the like or fibers, fillers, and the like are fallen from the wire, which may cause a marked increase in dehydration marks. As described above, industrial fabrics capable of satisfying any of the necessary properties such as surface property, fiber supporting property, and wear resistance have not yet been developed.

SUMMARY OF THE INVENTION

An object of the invention is to provide an industrial two-layer fabric exhibiting a uniform dehydration property throughout the fabric while causing neither a collapse of mesh openings which will otherwise occur at an interwoven position nor a problem of the related art, that is, clogging of the mesh openings with a warp binding yarn, having excellent surface smoothness, rigidity, water drainability, wear resistance, and fiber supporting property, and capable of preventing an increase in the wire thickness.

The industrial two-layer fabric according to the invention is characterized in that since at least one of the two warps of a first warp set is placed as a warp having a binding function, warps can form two designs simultaneously without collapsing the surface design of the fabric. The invention employs the following constitution in order to achieve the above-described object.

The present invention employs the following constitution in order to solve the above-described problem of the related art.

An industrial two-layer fabric includes an upper side fabric having upper side warps and upper side wefts, and a lower side fabric having lower side warps and lower side wefts. The upper side warps include a first warp set and a second warp set. The first warp set contains two of the upper side warps. At least one of the upper side warps of the first warp set functions as a warp binding yarn that binds the upper side fabric and the lower side fabric. The second warp set contains one of the upper side warps and one of the lower side warps placed below the one of the upper side warps. The first warp set and the second warp set are placed alternately and form a weave design of the upper side fabric. At a position where two adjacent lower side warps are woven with one of the lower side wefts, the warp binding yarn placed between the two adjacent lower side warps is woven with the same one of the lower side wefts.

The second warp set may contain two of the upper side warps that weave the upper side wefts in the same warp weave design. The one of the lower side wefts may pass only over the adjacent two lower side warps and the warp binding yarn between the adjacent two lower side warps and may pass under other lower side warps and other warp binding yarns. Two of the upper side warps of the first warp set may function as warp binding yarns that may alternately weave the lower side wefts.

The weave design of the upper side fabric may be any one of plain weave, twill weave, broken twill weave, satin weave, and broken satin weave. One or more auxiliary wefts may be placed between the upper side wefts.

The invention has an excellent effect of providing an industrial two-layer fabric exhibiting a uniform dehydration property throughout the fabric while not breaking the design of mesh openings at an interwoven position and preventing clogging of the mesh openings with a warp binding yarn, having excellent surface smoothness, rigidity, water drainability, wear resistance, and fiber supporting property, and capable of preventing an increase in the thickness of a wire or a fabric.

DESCRIPTION OF THE PREFERRED EMBODIMENT

Figure 1:
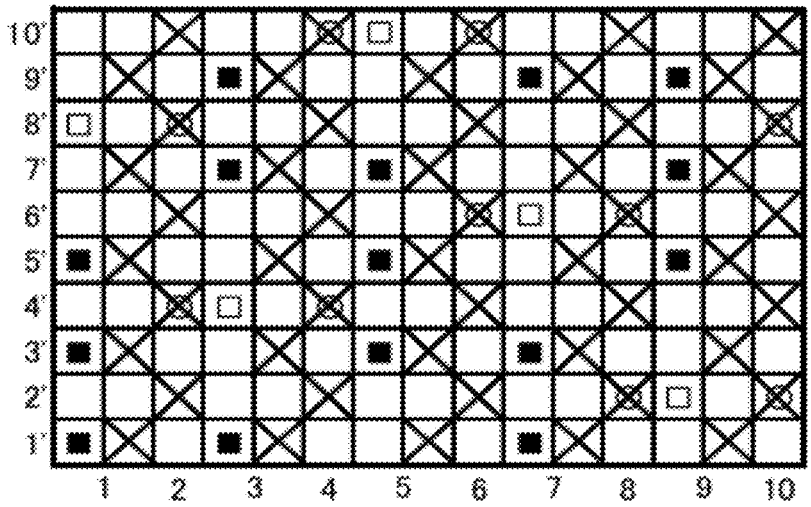
FIG. 1 is a design diagram showing a complete design of Example 1 relating to an industrial two-layer fabric of the invention.

Embodiments of the industrial two-layer fabric according to the invention will next be described. The following embodiments are only examples of the invention and do not limit the invention.

The industrial two-layer fabric according to the invention has, as constituent yarns thereof, upper side warps to be woven with upper side wefts and warp binding yarns to be woven with both upper side wefts and lower side wefts. One of the upper side warps and one of the warp binding yarns constitute a first warp set, in which the upper side warp is placed at the same level of or perpendicularly above the warp binding yarn of the fabric (which will hereinafter be called the upper side warp is placed "perpendicularly above" the warp binding yarn). The term "placed perpendicularly above" or "placed perpendicularly below" as used herein means that since an upper side warp is woven with only an upper side weft and a warp binding yarn is woven with both an upper side weft and a lower side weft, the upper side warp and the warp binding yarn do not completely overlap with each other and they are misaligned in practice. In addition to the first warp set of an upper side warp and a warp binding yarn, a second warp set of upper and lower warps, composed of an upper side warp solely woven with an upper side weft and a lower side warp solely woven with a lower side weft are placed perpendicularly above or below with each other.

An embodiment of the industrial two-layer fabric according to the invention is that an upper side fabric is comprised of a first warp set and a second warp set. The first warp set constitutes an upper side warp weave design and is placed alternately with the second warp set that also constitutes the upper side warp weave design. At least one of the upper side warps of the first warp set is a warp binding yarn that binds the upper side fabric and the lower side fabric. The second warp set includes one upper side warp and a lower side warp placed below the upper side warp perpendicularly. The warp binding yarn of the first warp set is woven with a lower side weft at a position where two adjacent lower side warps of the two adjacent second warp sets are woven with the same lower side weft. In other words, the warp binding yarn of the first warp set passes under a lower side weft and two adjacent lower side warps of the two adjacent second warp sets pass under the same lower side weft.

A second embodiment of the industrial two-layer fabric according to the invention is that the fabric is obtained by successively placing an upper side weave design comprised of the first warp set and the second warp set. The second warp set contains two upper side warps and a lower side warp. The two upper side warps have the same warp weave design and a lower side warp. In other words, the two upper side warps weave the same upper side wefts. At least one of the warps of the first warp set is a warp binding yarn and binds the upper side fabric and the lower side fabric. The warp binding yarn of the first warp set is woven with a lower side weft at a position where two adjacent lower side warps of the two adjacent second warp sets are woven with the same lower side weft. In other words, the warp binding yarn of the first warp set passes under a lower side weft and two adjacent lower side warps of the two adjacent second warp sets pass under the same lower side weft.

In the second embodiment, when one of the two warps of the first warp set (a warp binding yarn) passes up and down between the upper surface side and the lower surface side, the other upper side warp may form a design to be always woven with an upper side weft. In this case, the present embodiment is effective for lessening the influence of a position of the warp binding yarn that is away from the upper side surface of the fabric.

The diameter of the upper side warps of the first warp set may be made smaller than that of the warp of the second warp set. In this case, a single warp of the second warp set is balanced with the two smaller-diameter warps in size so that misalignment of a fabric design in a direction parallel to the fabric surface (which will hereinafter be called "horizontal direction") or one-sided alignment which will otherwise occur in places can be prevented. In the conventional fabrics, on the other hand, upper and lower wires are bound without collapsing a surface design by replacing or cooperating two warps each other. The fabric inevitably has an uneven surface because wefts are drawn at a bound position or a dehydration route is clogged because warps are arranged side by side. Paper manufactured using the resulting fabric is then likely to have a dehydration mark or a transferred wire mark.

In the present invention, at least one of the first warp set is made of a binding yarn having a function of binding upper and lower wires or fabrics. When the binding yarn is woven with a lower side weft, it is placed between two lower side warps that are woven with the same lower side weft. In this case, the binding yarn is protected by other lower side wefts adjacent to the weaving lower side weft and by the two lower side warps so that the warp binding yarn is not easily worn away. In addition, the lower side weft is woven with three warps, namely, two adjacent lower side warps and the inbetween warp binding yarn extended there-between, which improves rigidity, suppresses the generation of undesirable movement of yarns and an increase in the thickness of a wire (fabric), and facilitates securement of water drainability.

In the present invention, since the warps of the first warp sets (upper side warps and portions of binding yarns that do not weave lower side wefts) constantly form an upper side warp design and they contribute to form the upper side fabric design without breaking the upper side warp design even while portions of warp binding yarns serve as binding warps being woven with lower side wefts. Further in the present embodiment, a binding yarn having a binding function is woven with lower side weft at a position where two lower side warps are woven with the lower side weft so that drawing of the binding position decreases. In the conventional fabric, a binding-yarn set is drawn from the surface at more positions than a warp set so that there occurs a difference in height even if the binding-yarn set has the same design as that of the warp set. In particular, the difference is marked in the vicinity of the binding position and when the fabric is viewed as a whole, it is depressed only at the position, meaning that the fabric is inferior in surface smoothness. Compared with a fabric obtained using the binding method of the related art, the fabric obtained by the invention is free of collapse of surface smoothness and moreover, it does not have such a position.

For example, in an 8-shaft design, a lower side weft is strongly woven with three lower side warps and a long crimp design corresponding to five warps is formed on the lower surface side in a minimum repeating unit, which increases a wear volume and improves wear resistance. Three warps placed adjacent to each other are simultaneously and firmly woven with a lower side weft so that the resulting fabric has improved rigidity, the wire thickness can be decreased, increase in wear volume can be suppressed, and undesirable movement of a lower side weft can be prevented. In addition, a weft long crimp corresponding to five warps is formed on the lower side surface in a minimum repeating unit so that the resulting fabric has improved wear resistance. In a multi-shaft fabric having, for example, a 10-shaft design, a long crimp design corresponding to seven warps is formed on the lower surface side in a minimum repeating unit so that the design excellent in wear resistance can be obtained. Since three warps adjacent to each other are simultaneously woven with a lower side weft firmly, the resulting fabric is excellent in decrease in the thickness of wire, improvement in rigidity, and prevention of undesirable movement of a lower side weft.

No particular limitation is imposed on the upper side fabric weave design and any of plain weave, twill weave, broken twill weave, satin weave, randomly shifted satin weave, and the like design can be employed. Complete designs obtained using it are connected longitudinally and latitudinally to obtain a design excellent in diagonal rigidity, running stability, and wear resistance. The upper side fabric design may be an upper side complete design comprised of plural kinds of warp complete designs. Alternatively, auxiliary wefts having a smaller diameter than upper side wefts may be placed between the upper side wefts.

No particular limitation is imposed also on the lower side surface design. For example, preferred is a design in which a lower side weft passes over two successive lower side warps and/or lower warp binding yarns and then passes under two or more successive lower side warps and/or lower warp binding yarns to form a long crimp of the lower side weft on the lower side surface. By employing a design in which two adjacent warps on the lower surface side are simultaneously woven with a lower side weft, the long crimp of the lower side weft protrudes further from the surface so that the resulting fabric has improved wear resistance and at the same time improved rigidity. It is also recommended that two adjacent warps are woven with a lower side weft from the lower surface side and at this position, alternately approach warps lying on both sides, thereby forming substantially zigzag arrangement of warps.

In the present embodiment, both of the two warps of the first warp set may be a binding yarn having a binding function. Even if both are binding yarns, the resulting fabric, different from the conventional fabric, does not have a position at which binding yarns replace each other, so that neither partial clogging of the mesh openings nor drawing of the binding yarn from the surface occurs. In addition, the binding positions are dispersed in the fabric so that both of the two warps are preferably binding yarns.

Yarns to be used in the present embodiment may be selected depending on the intended use. Examples of it include, in addition to monofilaments, multifilaments, spun yarns, finished yarns subjected to crimping or bulking such as so-called textured yarn, bulky yarn, and stretch yarn and yarns obtained by intertwining them. As the cross-section of the yarn, not only circular shape but also square or short shape such as stellar shape, or elliptical or hollow shape can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool, and metal. It is needless to say that yarns obtained using copolymers or incorporating or mixing the above-described material with a substance selected depending on the intended use may be used. As upper side warps, lower side warps, lower warp binding yarns, and upper side wefts for a papermaking wire, use of a polyester monofilament having rigidity and excellent dimensional stability is usually preferred. As lower side wefts which need wear resistance, those obtained by interweaving of polyester monofilaments and polyamide monofilaments, for example, by arranging them alternately are preferred from the standpoint of improving wear resistance while maintaining rigidity.

With regard to the diameter of a constituent yarn, it is preferred that upper side wefts have preferably a smaller diameter than lower side wefts from the standpoint of surface smoothness and fiber supporting property. The diameter of warps can be selected as needed. All the warps may have the same diameter or lower side warps may have a greater diameter than the other warps. Thus, the diameter can be selected as needed.

Examples of the industrial two-layer fabric according to the invention will hereinafter be described based on accompanying drawings. FIGS. 1 to 5 are design diagrams showing examples relating to the industrial two-layer fabric of the invention. The term "design diagram" that shows a "complete design" of a fabric as used herein means a minimum repeating unit of a fabric design and a whole fabric design is formed by connecting this complete design longitudinally and latitudinally. In these design diagrams, warps are indicated by Arabic numerals, for example 1, 2 and 3. In the present invention, there are two kinds of warp sets, that is, a first warp set of two warps at least one of which has a binding function, and a second warp set of an upper side warp and a lower side warp. Wefts are indicated by Arabic numerals with a prime, for example, 1', 2' and 3'. According to an arrangement ratio, an upper side weft and a lower side weft may be placed perpendicularly or only an upper side weft is placed. In the diagrams, a cross "x" indicates that an upper side warp lies or passes over an upper side weft, a solid square "■" indicates that a binding yarn lies or passes over an upper side weft, an open square "□" indicates that a binding yarn lies or passes under a lower side weft, and an open circle "○" (including an elliptical shape in the drawing) indicates that a lower side warp lies or passes under a lower side weft.

An upper side warp and a lower side warp, or an upper side weft and a lower side weft sometimes perpendicularly overlap with each other. With regards to wefts, some upper side wefts do not have a lower side weft thereunder according to an arrangement ratio. In the design diagrams, upper and lower yarns are depicted as being perpendicularly overlapped precisely. They are however illustrated as such for convenience of drawing and misalignment is allowed in the actual fabric.

Example 1

FIG. 1 is a design diagram of an industrial two-layer fabric of Example 1 according to the invention. This fabric is a 10-shaft fabric in which a first warp set of two warps (1, 3, 5, 7, 9) comprised of an upper side warp having a binding function (left side columns) and an upper side warp having no binding function (right side columns) and a second warp set of upper and lower warps (2, 4, 6, 8, 10) comprised of an upper side warp and a lower side warp. The first warp set (1, 3, 5, 7, 9) and the second warp set (2, 4, 6, 8, 10) are arranged alternately. Upper side wefts (1', 2', 3', 4', 5', 6', 7', 8', 9', 10') and lower side wefts (2', 4', 6', 8', 10') arranged at the rows where "□" and "○" appear are arranged at a ratio of 2:1.

In the upper side fabric, an every upper side warp alternately passes over and under upper side wefts and thus forms a 1/1 warp design (plain weave fabric design) and at the same time, a first warp set and a second warp set are arranged alternately.

Of the first warp set, a first upper side warp (left side column of warp 1 of FIG. 1) is a warp having a binding function as a warp binding yarn and it is woven with upper side wefts and a lower side weft to bind an upper side fabric and a lower side fabric. For example, the first upper side warp 1 is woven with the upper side wefts 1', 3', and 5' and woven with the lower side weft 8'. The first upper side warp 1 forms a 1/1 warp design with the upper wefts 1'-6' and 10' and does not form a 1/1 warp design at the rest of the wefts where the first warp functions as a binding yarn with the lower weft 8'. On the other hand, a second upper side warp (right side column of warp 1 of FIG. 1) is an upper side warp that does not have a binding function and forms a 1/1 warp design (plain weave fabric design) with the upper wefts 1'-10' including the parts where the first upper side warp 1 (binding yarn 1) does not function as an upper side warp with the upper side wefts 7', 8' and 9'. The first and second upper side warps of the first warp set are woven with the same upper side wefts and together form a design corresponding to the design formed by a single upper side warp.

An every upper side warp of a second warp set is placed adjacent to the first warp set and forms the same 1/1 warp design as that of the first warp set. A plain weave design of the upper side fabric is formed by shifting the above-described design formed by the first and second warp sets by one upper side weft equivalent distance.

Described specifically, the first upper side warp 1 of the first warp set having binding function (left column of FIG. 1) passes over an upper side weft 1', under an upper side weft 2', over an upper side weft 3', under an upper side weft 4', and over an upper side weft 5'. Then, without passing over upper side wefts 7' and 9' over which it is originally supposed to pass, it passes between an upper side weft 6' and a lower side weft 6', under an upper side weft 7', under a lower side weft 8', under an upper side weft 9', and between an upper side weft 10' and an lower side weft 10'. The second upper side warp 1 having no binding function (right column of FIG. 1), which is an upper side warp, passes over the upper side weft 1' and under the upper side weft 2' similar to the first warp and thus forms 1/1 warp design to form a plain weave design of the upper side fabric. These two warps form a design corresponding to a single upper side warp in cooperation. An upper side warp 2 of the second warp set placed adjacent to the first warp set forms a 1/1 warp design that is the same as that of the first warp set, but it forms a plain weave design by shifting the warp design of the first warp set by a single upper side weft equivalent distance. More specifically, the upper side weft 2' of the second warp set passes over the upper side weft 2' and then passes under the upper side weft 3' and thus forms a plain weave design.

No limitation is imposed on the design of the lower side fabric insofar as it has a position at which two adjacent lower side warps are simultaneously woven with the same lower side weft. Further, when the upper side warp having a binding function (warp binding yarn) is woven with a lower side weft, the upper side warp is woven with the lower side weft at the position where two adjacent lower side warps are simultaneously woven with the same lower side weft. Two adjacent lower side warps and a warp binding yarn between the two adjacent lower side warps are woven with a lower side weft so that the resulting fabric has improved rigidity and is excellent from the standpoint of an increase in wear volume and the like. In addition, it becomes a fabric having good wear resistance due to a lower side weft long crimp thus formed. For example, the lower side weft 4' of FIG. 1 passes only over the adjacent two lower side warps 2 and 4, and the warp binding yarn 3 between the two adjacent lower side warps 2 and 4, and passes under other three lower side warps 6, 8, and 10 and other four warp binding yarns 1, 5, 7 and 9. Accordingly, a long crimp of a seven warp length is formed on a lower side fabric side.

More specifically, a lower side warp 2 passes under lower side wefts 4' and 8' and over lower side wefts 2', 6', and 10' and thus forms a 1/2-1/1 warp design on the lower surface side of the lower fabric. A lower side warp 4 adjacent to the lower side warp 2 passes under lower side wefts 4' and 10' and over lower side wefts 2', 6', and 8' and thus forms a 1/2-1/1 warp design on the lower side surface. The lower side warp 4 forms a 1/2-1/1 design by shifting the design by three-lower side weft equivalent distance.

The warp 3 having a binding function (binding yarn 3 of the left column of FIG. 1) binds upper and lower fabrics by being woven with the upper side wefts 1', 7' and 9' from the upper side, and woven with the lower side weft 4' from the lower side at the position where the adjacent lower side warps 2 and 4 are simultaneously woven with the lower side weft 4' from the lower side. The binding yarn 3 is protected by the adjacent lower side wefts 2' and 6' as well as the two adjacent lower side warps 2 and 4 from wear.

In Example 1, the warp binding yarn is woven with a lower side weft between two lower side warps which are woven with the same lower side weft. As seen in FIG. 1, one white square between two white circles is present once only in each of lower side wefts 2', 4', 6', 8' and 10'. A binding yarn woven by a lower side weft is protected by adjacent lower side wefts as well as two adjacent lower side warps from wear. In addition, the lower side weft is woven with three warps, which improves rigidity, suppresses the generation of undesirable movement of yarns and an increase in the thickness of a wire, and facilitates securement of water drainability.

The warps of the first warp set form an upper side warp design. They constantly form the upper side warp design without collapsing the design while one of the first warp set serves as a binding yarn so that drawing from the upper surface is not likely to occur where the binding yarn is woven with a lower side weft. Further, in Example 1, the warp binding yarn is woven with a lower side weft at a position where two adjacent lower side warps are woven with the same lower side weft so that drawing of the binding portion from the upper surface also decreases. In the conventional fabric, a set of a binding yarn has more drawing positions than a set of a warp so that even when the set of a binding yarn and the set of a warp have the same design, there occurs a somewhat difference in height. In particular, the difference in height is marked in the vicinity of the binding portion. The fabric as a whole therefore seems to be depressed at that position so that the fabric is inferior in surface smoothness. The fabric obtained in Example 1 can keep its surface smoothness compared with the binding structure of conventional fabrics and moreover, it is free of the collapse of surface smoothness.

In the conventional fabrics, in addition, there is a difference between the set of a binding yarn and the set of a warp in the overlapping manner of an upper side warp and a lower side warp. The set of a warp is a set of an upper side warp and a lower side warp in which the upper side warp is woven with only an upper side weft and the lower side warp is woven with only a lower side weft. When a wire is viewed perpendicularly from the upper surface side to the lower surface side, the upper and lower warps substantially overlap each other. With regards to the set of a binding yarn, on the other hand, two warps are placed perpendicularly. One of them should be woven with both upper and lower wefts and a design corresponding to a single warp should be formed so that there exists a position where these two warps replace each other. Different from the set of a warp, the warps of the set of a binding yarn do not completely overlap each other perpendicularly. In particular, at a position where the two warps replace each other, they are arranged side by side so that the mesh openings are clogged at this position, which may become a factor for clogging of a dehydration route, deterioration in smoothness on the surface of the fabric, and the like and as a result, cause dehydration marks.

On the other hand, the fabric of Example 1 has two kinds of warps for forming an upper side surface, that is, a set of two warps and a set of a single warp. In binding upper and lower wires (fabrics) to each other in Example 1, one of the two warps of the first warp set serves as a binding yarn so that the surface design can be formed without changing a shape or without replacing two warps each other and at the same time, the two warps always exist at the same position. Different from the conventional fabric having a replacement position of warps, neither misalignment in a horizontal direction nor one-sided alignment occurs. In addition, in Example 1, since a ratio of warps on the lower surface side is smaller, a sufficient dehydration route can be ensured. Judging from the above, the mesh openings on the upper surface side are likely to be clogged compared with the conventional fabric, but a dehydration route in a perpendicular direction is secured constantly so that this design does not adversely affect the dehydration property. It is needless to say that the dehydration route in an oblique direction is also secured so that there occurs no partial clogging of the mesh openings. The structure of the present example has therefore remarkable effects for achieving a uniform dehydration property and excellent surface smoothness. Such a structure and function can be understood from the comparison between FIG. 6 and FIG. 8.

Figure 6:
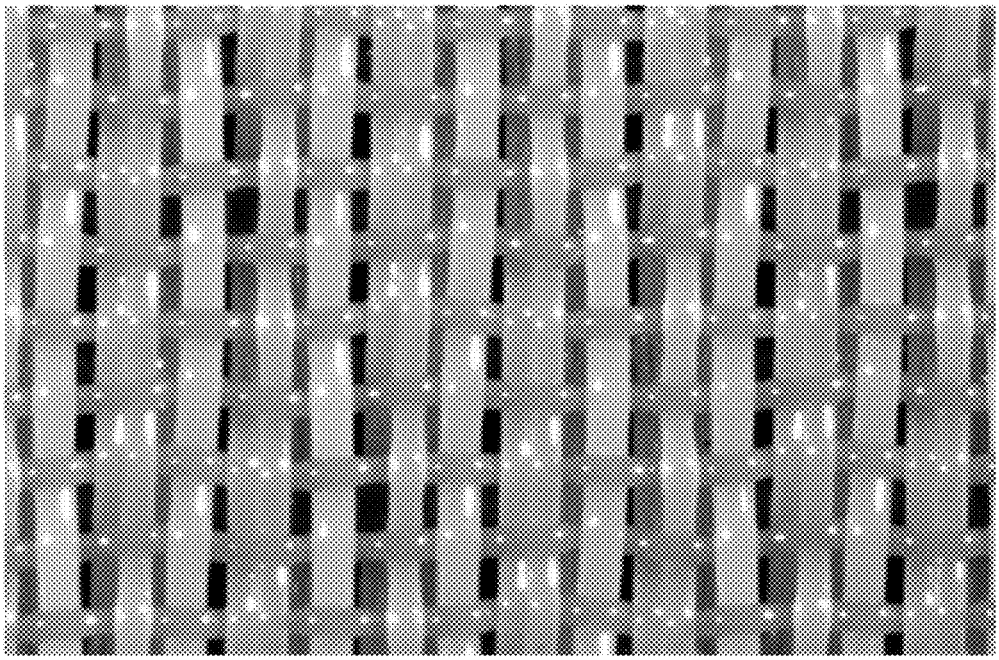
FIG. 6 is a planar photograph of an upper side surface showing an example of the industrial two-layer fabric according to the invention.
Figure 7:
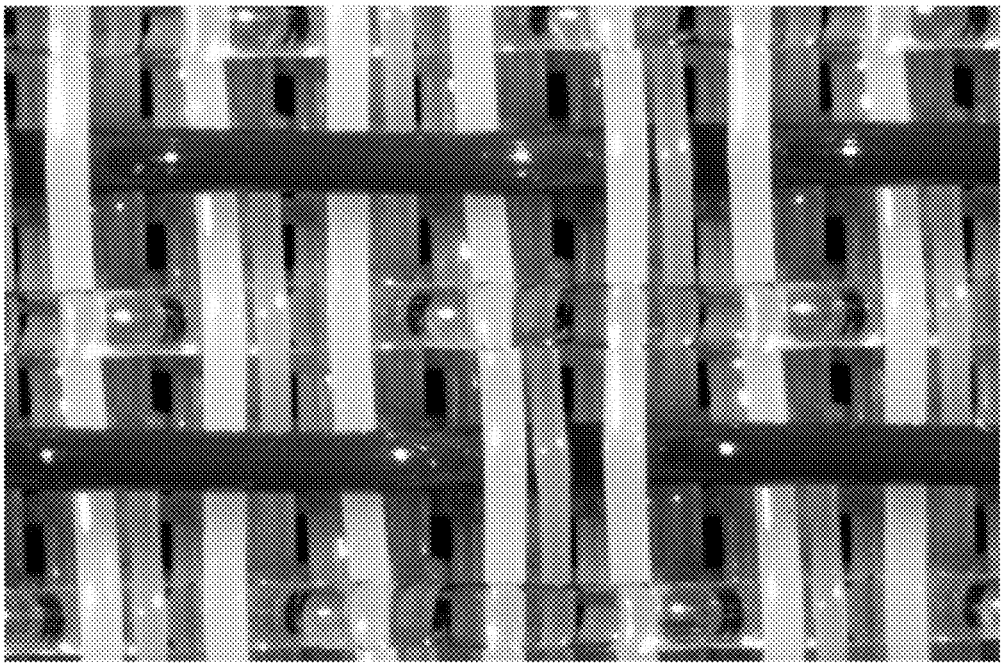
FIG. 7 is a planar photograph of a lower side surface showing an example of the industrial two-layer fabric according to the invention.

FIG. 6 is a partial photograph showing an example of the upper surface side of the embodiment relating to the industrial two-layer fabric of the present example; FIG. 7 is a partial photograph of the lower surface side of the fabric; and FIG. 8 is a partial photograph of the upper surface side of an industrial two-layer fabric relating to the related art.

In the industrial two-layer fabric according to the present example shown in FIGS. 6 and 7, the upper side fabric is comprised of an upper side warp design having a first warp set and an upper side warp design having a second warp set. The first warp set and the second warp set are arranged alternately. One of the two warps of the first warp set constituting the upper side warp design serves as a warp binding yarn for binding an upper side fabric and a lower side fabric. At a position where two lower side warps are woven with a lower side weft, this warp binding yarn is woven with the lower side weft.

The fabric shown in FIGS. 6 and 7 uses, for the first warp set, warps having a diameter smaller than that of the warp of the second warp set, but they may have the same diameter.

Figure 8:
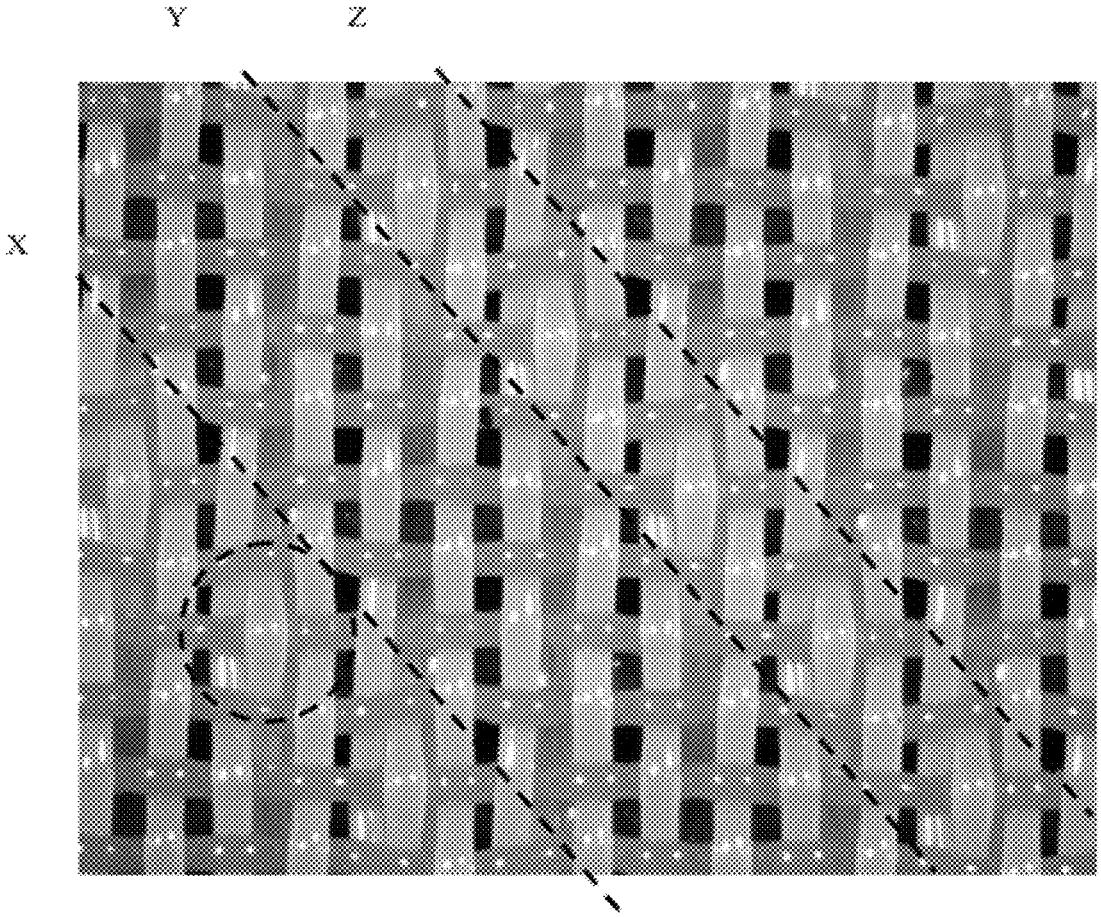
FIG. 8 is a planar photograph of an upper side surface showing an example of a conventional industrial two-layer fabric.

The fabric shown in FIG. 8 is a fabric obtained by interweaving upper and lower fabrics by complementing a knuckle-free position of an upper side warp with a knuckle formed with a warp binding yarn while carrying out successive interweaving, and thereby preventing collapse of the design.

In the fabric of FIG. 8, since the warp binding yarn forms an intersection with the upper side warp at a position where it forms a knuckle on the upper surface side, the warp binding yarn is not completely on the side of the upper side warp when they are arranged side by side. It is apparent from the photograph of FIG. 8 that the mesh openings at the position are clogged compared with another position. In addition, the knuckles complemented with the knuckle formed with a warp binding yarn are arranged successively in an oblique direction so that a clear boundary appears between a portion where mesh openings are open between lines X and Y of FIG. 8 and a portion where mesh openings are clogged between lines Y-Z of FIG. 8. Generation of spots in an oblique direction can be confirmed. They remain as spots of dehydration and give paper an oblique mark in a papermaking step.

Further, in the conventional fabrics using only one kind of an upper side warp for an upper side warp that constitutes an upper side surface, the upper side warp and a lower side warp should cooperate with each other as a warp to form an upper side surface design without collapsing it. The upper side warp and the lower side warp form a design corresponding to a single warp. For example, at a position where the lower side warp is woven with an upper side weft, the upper side warp is not woven with the upper side weft which it is originally supposed to be woven with and it passes under the upper side weft. At this time, two warps overlap each other in a perpendicular direction of the fabric and form a design corresponding to a single warp, but they are actually misaligned in a horizontal direction. In particular, at a position where upper and lower warps replace each other, these two warps lie side by side as the warps between the lines Y and Z of FIG. 8. Further, at the other position, an upper side warp and a lower side warp do not overlap completely. Thus, due to misalignment of the warp and a large difference between an open portion and a clogged portion of the mesh openings at a position where a binding yarn passes up and down, a sufficient dehydration route is not secured in places. In a step of dehydration of raw materials which have landed on a papermaking machine, it may lead to a dehydration mark or a transferred wire mark and the paper thus manufactured inevitably has irregularities or uneven thickness. In the binding design of the conventional fabrics, the binding is effected by the cooperation of the binding yarn and the warp so that they are inevitably drawn from the surface in places. This is because warps including a warp binding yarn should go up and down different from warps which form a warp design only from an upper side warp or a lower side warp.

In addition, in the conventional fabrics, there is also a difference in the overlapping manner of an upper side warp and a lower side warp between a set of a binding yarn and a set of an upper side warp. The term "set of a warp" as used herein means a set of an upper side warp to be woven only with an upper side weft and a lower side warp to be woven only with a lower side weft. In such a structure, when a wire is viewed in a perpendicular direction from the upper surface side to the lower surface side, the upper and lower warps substantially overlap each other. With regards to the set of a binding yarn, on the other hand, two warps are placed perpendicularly. One of them should be woven with both upper and lower wefts and a design corresponding to a single warp should be formed so that there exists a position where these two warps replace and cross each other. Different from the set of a warp, the binding yarns do not completely overlap perpendicularly. In particular, at a position where the two warps replace each other, they lie side by side so that the mesh openings are clogged at this position, which may become a factor for clogging of a dehydration route, deterioration in smoothness on the surface of the fabric, and the like and as a result, cause dehydration marks.

In the industrial two-layer fabric according to the present example, on the other hand, two kinds of warps form an upper side surface. They are a set of two warps having a smaller diameter and a single warp having a large diameter. When upper and lower wires are bound in the fabric of the present example, they are bound not with the warp of a large diameter but with one of the two warps having a smaller diameter. It is therefore possible to form a surface design without changing the shape of the warp design or replacing warps each other and to place the warps of the first warp set always at the same position.

In the fabric of the present example, different from the conventional fabrics having a replacing and crossing position of warps, warps are free of misalignment in a horizontal direction or one-sided alignment. A sufficient dehydration route is secured in the fabric of the present example, because a warp ratio on the lower surface side is small. This suggests that the mesh openings on the upper surface side tend to be clogged compared with the conventional fabrics, but a dehydration route in a perpendicular direction is secured sufficiently so that the structure of the present example has no adverse effect on the dehydration property. It is needless to say that the dehydration route in an oblique direction is also secured sufficiently so that the fabric of the present example is free of partial clogging of the mesh openings. Thus, the structure of the present example has a marked effect for achieving a uniform dehydration property and excellent surface smoothness. Such a structure and function can be understood from the comparison between the photographs of FIGS. 6 and 8.

The fabric of the present example has, as warps forming an upper side surface, two kinds of warps, that is, a set of two warps having a smaller diameter and a single warp having a large diameter. When upper and lower wires are bound in the fabric of the present example, they are bound not with the warp of a large diameter but with one of the two warps having a smaller diameter. It is therefore possible to form a surface design without changing the shape of the warp design or providing a replacing and crossing position and to place the warp binding yarn always at the same position. Different from the conventional fabrics having a replacing and crossing position of warps, they are free of misalignment in a horizontal direction or one-sided alignment.

In addition, a sufficient dehydration route is secured in the fabric of the present example, because a warp ratio on the lower surface side is small. This suggests that the mesh openings on the upper surface side tend to be clogged compared with the conventional fabrics, but a dehydration route in a perpendicular direction is secured sufficiently so that the structure of the present example has no adverse effect on the dehydration property. The dehydration route in an oblique direction is also secured sufficiently so that the fabric of the present example is free of clogging of the mesh openings throughout the fabric and has a marked effect for achieving a uniform dehydration property and excellent surface smoothness.

In the present example, when one of the two warps of the first warp set runs between the upper surface side and the lower surface side, the other warp is always woven with an upper side weft so that the fabric is almost free of the influence of one of the two warps running between the upper surface side and the lower surface side. In the present example, a second warp set is used as a standard and two warps of the first warp set therefore forms a design corresponding to a single warp. A space corresponding to two warps is originally secured so that neither misalignment in a horizontal direction nor one-sided alignment occurs in places. In the conventional fabrics, on the other hand, upper and lower warps replace or cooperate each other to bind upper and lower wires without collapsing the surface design. At the bound position, there inevitably occurs roughness on the surface of the fabric due to drawing of wefts from the surface or clogging of a dehydration route due to warps arranged side by side. Then, paper obtained using the resulting fabric is likely to have a dehydration mark or a transferred wire mark.

Example 2

Figure 2:
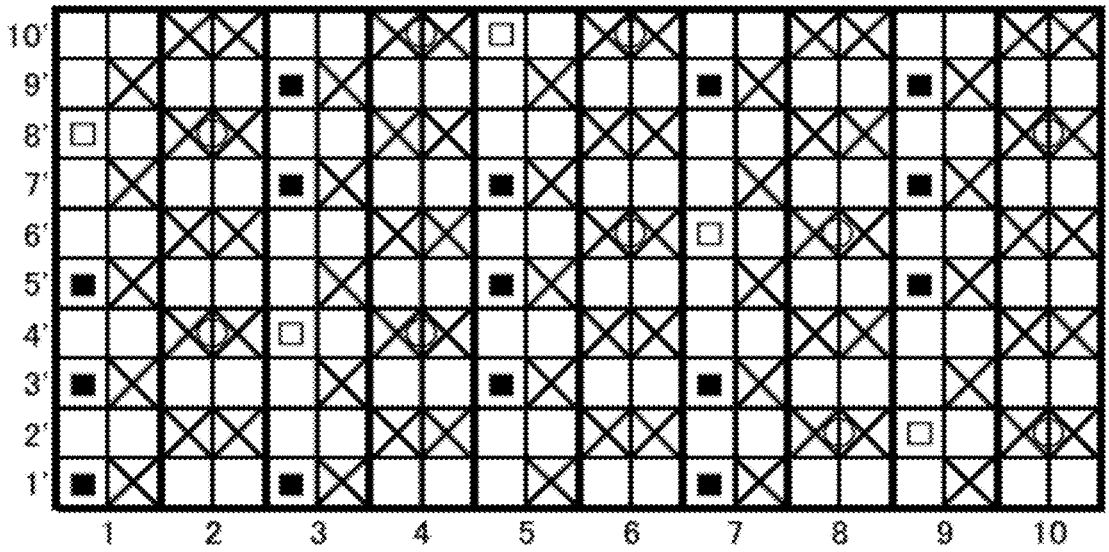
FIG. 2 is a design diagram showing a complete design of Example 2 relating to the industrial two-layer fabric of the invention.

FIG. 2 is the design diagram of an industrial two-layer fabric of Example 2 according to the invention.

In Example 1, the upper side fabric is comprised of a first warp set and a second warp set and the second warp set includes one upper side warp and one lower side warp, while in Example 2, the second warp set includes two upper side warps and one lower side warp. Described specifically, it is a 10-shaft fabric. A first warp set (1, 3, 5, 7, 9) comprised of an upper side warp having a binding function (a warp binding yarn) (left columns of FIG. 2) and an upper side warp having no binding function (right columns of FIG. 2). A second warp set of upper and lower warps (2, 4, 6, 8, 10) comprised of two upper side warps having no binding function (left and right columns of FIG. 2) and a lower side warp (the middle of the columns). The first warp set and the second warp set are arranged alternately.

Upper side wefts and lower side wefts are arranged at a ratio of 2:1. In FIG. 2, the upper wefts are 1', 2', 3', 4', 5', 6', 7', 8', 9' and 10' whereas the lower wefts are 2', 4', 6', 8' and 10' where two white circles and one white square between the two white circles are present in each of the rows of FIG. 2.

Using such a fabric makes it possible to prevent mesh openings from being clogged with the warp binding yarn and to achieve a uniform dehydration property throughout the fabric without collapsing the design of the mesh openings at an interwoven position. As a result, an industrial two-layer fabric excellent in surface smoothness, rigidity, water drainability, wear resistance, and fiber supporting property and not increasing the thickness of a wire can be provided.

Example 3

Figure 3:
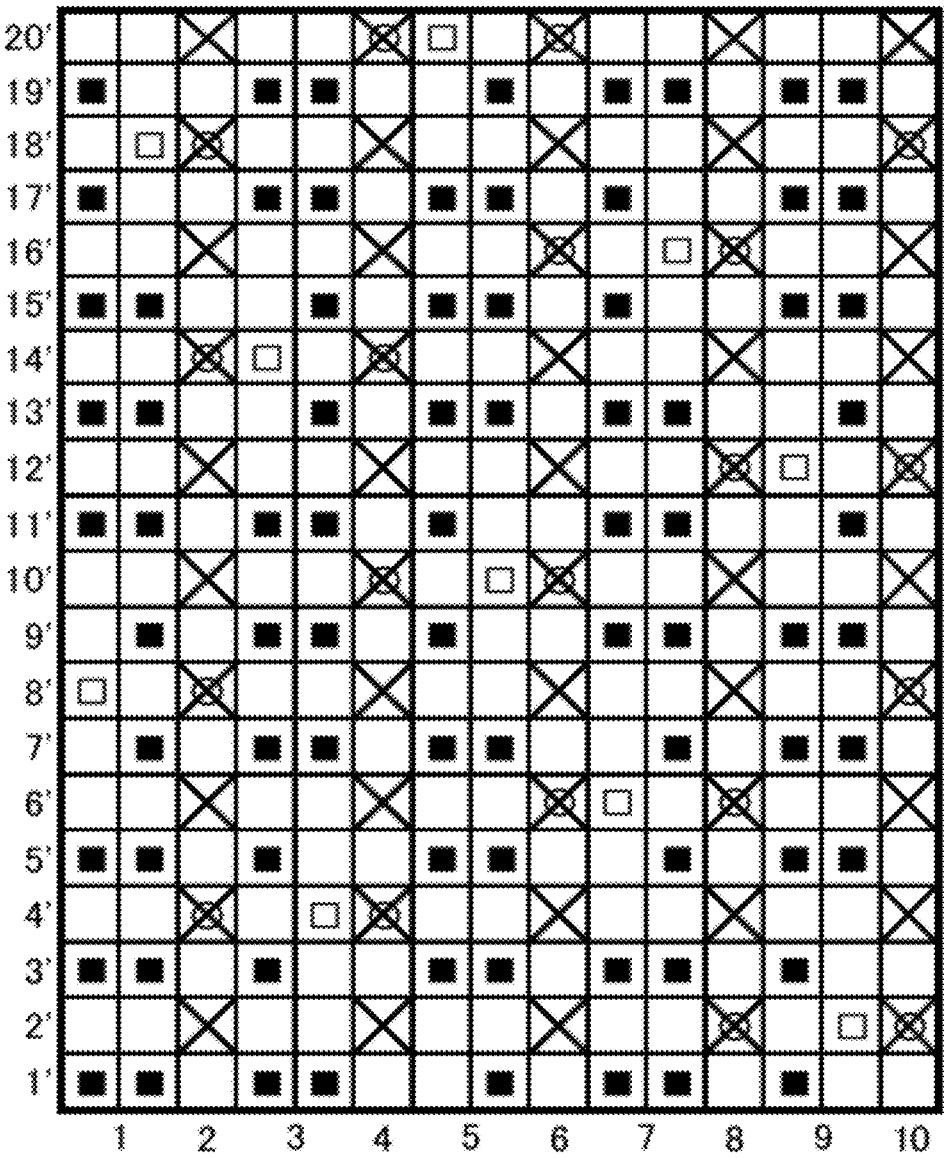
FIG. 3 is a design diagram showing a complete design of Example 3 relating to the industrial two-layer fabric of the invention.

FIG. 3 is the design diagram of an industrial two-layer fabric of Example 3 according to the invention.

In Example 1, the first warp set is comprised of an upper side warp having a binding function and an upper side warp having no binding function. In Example 3, on the other hand, a first warp set is comprised of only upper side warps having binding function. The two of the upper side warps of the first warp set alternately weave lower side wefts at each position where the two adjacent lower side warps are woven with one of the lower side wefts.

Described specifically, it is a 10-shaft fabric in which a first warp set (1, 3, 5, 7, 9) comprised of an upper side warp having a binding function and a second warp set of upper and lower warps (2, 4, 6, 8, 10) are arranged alternately.

Upper side wefts and lower side wefts are arranged at a ratio of 2:1. In FIG. 3, the upper wefts are 1', 2', 3', 4', 5', 6', 7', 8', 9', 10', 11', 12', 13', 14', 15', 16', 17', 18', 19' and 20' whereas the lower wefts are 2', 4', 6', 8', 10', 12', 14', 16', 18' and 20' where two white circles and one white square between the two white circles are present in each of the rows of FIG. 3. It is apparent that the two of the upper side warps alternately weave lower side wefts at each position where the two adjacent lower side warps are woven with one of the lower side wefts. For example, the first upper warp 1 (left column of FIG. 3) is woven with the lower side weft 8' and the second upper warp 1 (right column of FIG. 3) is woven with the lower side weft 18' alternately. The adjacent two lower side warps 10 and 2 weave the lower side wefts 8' and 18' together with the first or second upper warp 1.

Using such a fabric makes it possible to prevent mesh openings from being clogged with the warp binding yarn and to achieve a uniform dehydration property throughout the fabric without collapsing the design of the mesh openings at an interwoven position. As a result, an industrial two-layer fabric excellent in surface smoothness, rigidity, water drainability, wear resistance, and fiber supporting property and not increasing the thickness of a wire can be provided.

Example 4

Figure 4:
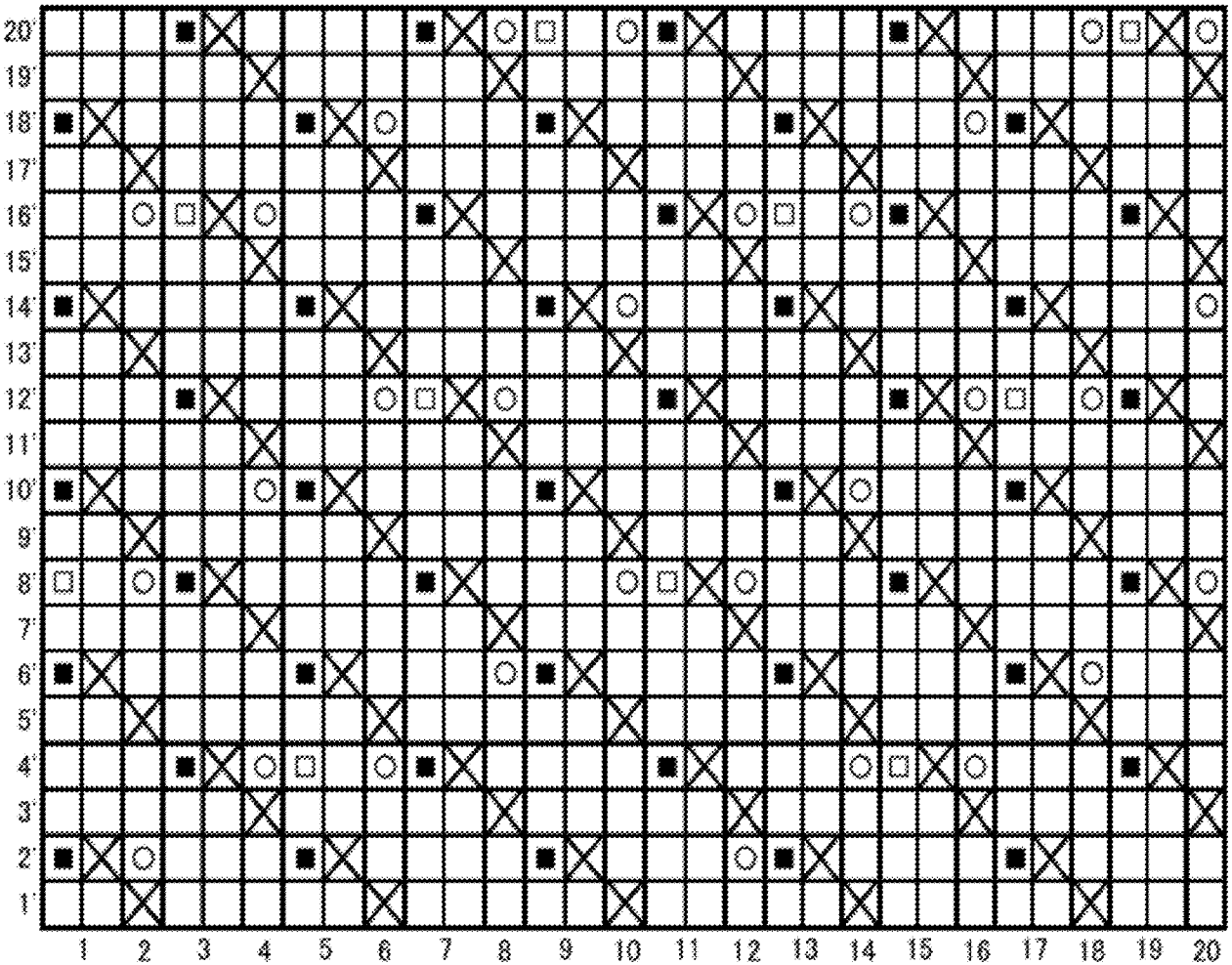
FIG. 4 is a design diagram showing a complete design of Example 4 relating to the industrial two-layer fabric of the invention.

FIG. 4 is the design diagram of an industrial two-layer fabric of Example 4 according to the invention. In Example 1, the upper side warp design is a plain weave, but that of Example 4 is a satin weave. Described specifically, it is a 20-shaft fabric in which a first warp set (1, 3, 5, 7, 9, 11, 13, 15, 17, 19) comprised of an upper side warp having a binding function and an upper side warp having no binding function and a second warp set of upper and lower warps (2, 4, 6, 8, 10, 12, 14, 16, 18, 20) are arranged alternately.

Upper side wefts and lower side wefts are arranged at a ratio of 2:1. In FIG. 4, the upper wefts are 1', 2', 3', 4', 5', 6', 7', 8', 9', 10', 11', 12', 13', 14', 15', 16', 17', 18', 19' and 20' whereas the lower wefts are 2', 4', 6', 8', 10', 12', 14', 16', 18' and 20' where two white circles and one white square between the two white circles, or circles only, are present in each of the rows of FIG. 4.

Using such a fabric makes it possible to prevent mesh openings from being clogged with the warp binding yarn and to achieve a uniform dehydration property throughout the fabric without collapsing the design of the mesh openings at an interwoven position. As a result, an industrial two-layer fabric excellent in surface smoothness, rigidity, water drainability, wear resistance, and fiber supporting property and not increasing the thickness of a wire can be provided.

Example 5

Figure 5:
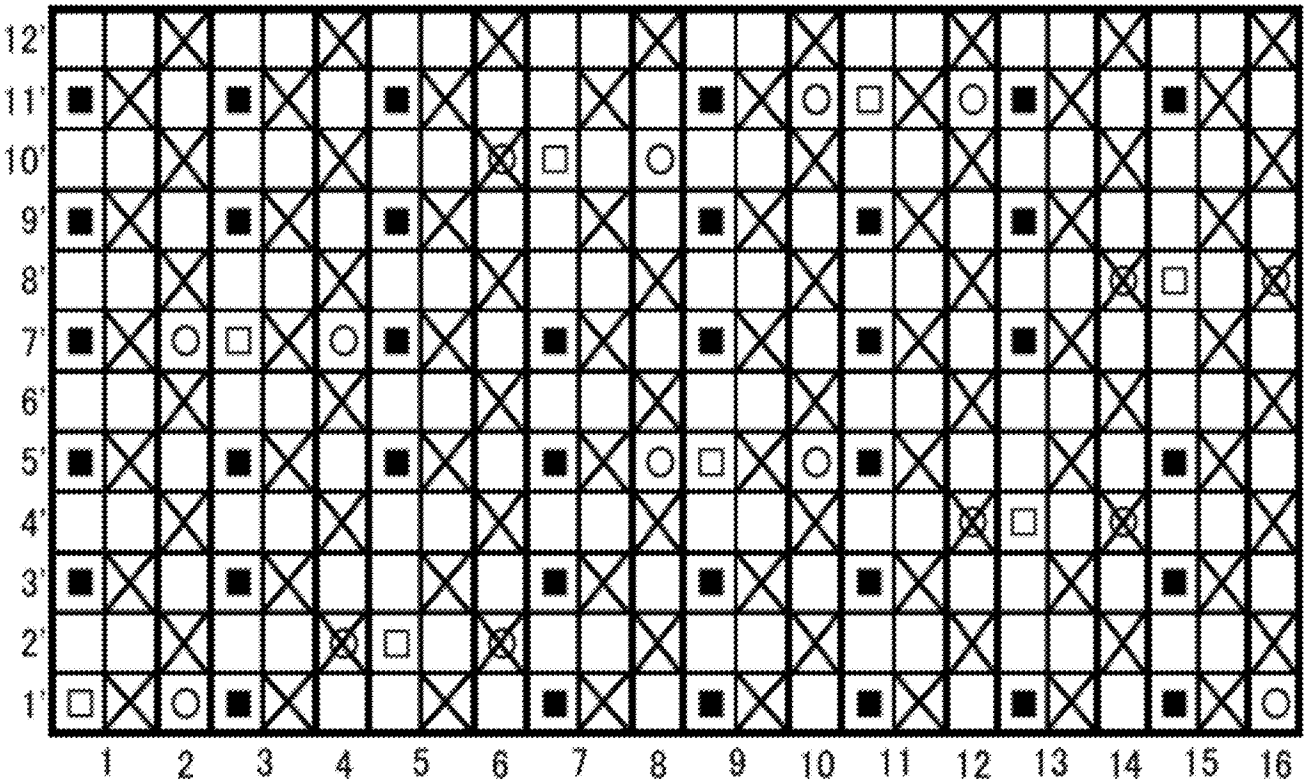
FIG. 5 is a design diagram showing a complete design of Example 5 relating to the industrial two-layer fabric of the invention.

FIG. 5 is the design diagram of an industrial two-layer fabric of Example 5 according to the invention. In Example 1, upper side wefts and lower side wefts are arranged at a ratio of 2:1, while in Example 5, they are arranged at a ratio of 3:2. Described specifically, it is a 16-shaft fabric in which a first warp set (1, 3, 5, 7, 9, 11, 13, 15) comprised of an upper side warp having a binding function and an upper side warp having no binding function and a second warp set of upper and lower warps (2, 4, 6, 8, 10, 12, 14, 16) are arranged alternately.

Upper side wefts and lower side wefts are arranged at a ratio of 3:2. In FIG. 5, the upper wefts are 1', 2', 3', 4', 5', 6', 7', 8', 9', 10', 11' and 12' whereas the lower wefts are 1', 2', 4', 5', 7', 8', 10' and 11' where two white circles and one white square between the two white circles are present in each of the rows of FIG. 5.

Using such a fabric makes it possible to prevent mesh openings from being clogged with the warp binding yarn and to achieve a uniform dehydration property throughout the fabric without collapsing the design of the mesh openings at an interwoven position. As a result, an industrial two-layer fabric excellent in surface smoothness, rigidity, water drainability, wear resistance, and fiber supporting property and not increasing the thickness of a wire can be provided.

The preceding description has been presented only to illustrate and describe exemplary embodiments of the present industrial two-layer fabric. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An industrial two-layer fabric comprising:

an upper side fabric comprising upper side warps and upper side wefts; and a lower side fabric comprising lower side warps and lower side wefts;

wherein the upper side warps comprises a first warp set that contains two of the upper side warps and a second warp set that contains one of the upper side warps and one of the lower side warps placed below the one of the upper side warps; the first warp set and the second warp set are placed alternately; at least one of the upper side warps of the first warp set functions as a warp binding yarn that binds the upper side fabric and the lower side fabric;

wherein, at a position where two adjacent lower side warps of adjacent second warp sets pass under one of the lower side wefts, the warp binding yarn placed between the two adjacent lower side warps passes under the one of the lower side wefts; and wherein the two adjacent lower side warps and the warp binding yarn pass over two lower side wefts adjacent to the one of the lower side wefts.

2. An industrial two-layer fabric according to claim 1, wherein the second warp set comprises two of the upper side warps that weave the same upper side wefts.

3. The industrial two-layer fabric according to claim 1, wherein the one of the lower side wefts passes only over the adjacent two lower side warps and the warp binding yarn between the two adjacent lower side warps and passes under other lower side warps and other warp binding yarns.

4. The industrial two-layer fabric according to claim 1, wherein the two of the upper side warps of the first warp set function as warp binding yarns.

5. The industrial two-layer fabric according to claim 4, wherein the two of the upper side warps alternately weave lower side wefts at each position where the two adjacent lower side warps are woven with one of the lower side wefts.

6. The industrial two-layer fabric according to claim 1, wherein an upper side fabric design is any one of plain weave, twill weave, broken twill weave, satin weave, and broken satin weave.

7. The industrial two-layer fabric according to claim 1, wherein one or more auxiliary wefts are placed between the upper side wefts.

8. The industrial two-layer fabric according to claim 1, wherein the number of the upper side wefts is at least equal to but not greater than twice the number of the lower side wefts.

9. The industrial two-layer fabric according to claim 1, wherein the diameter of the upper side warps of the first warp set is smaller than the diameter of the upper side warp of the second warp set.

* * * * *